US007631832B1

(12) United States Patent
Chen

(10) Patent No.: US 7,631,832 B1
(45) Date of Patent: Dec. 15, 2009

(54) PACKING FILM STRETCHING AND REWINDING MACHINE

(76) Inventor: Chun-Tsai Chen, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 12/353,266

(22) Filed: Jan. 14, 2009

(51) Int. Cl.
*B65H 19/22* (2006.01)

(52) U.S. Cl. ..... 242/533.1; 242/533.4

(58) Field of Classification Search ... 242/533.1–533.7, 242/535, 535.1–535.3, 539, 548, 548.1–548.3; 26/71, 99; 28/245
See application file for complete search history.

(56) References Cited

U.S. PATENT DOCUMENTS 3,592,403 A * 7/1971 Schmitt et al. ..... 242/527.5
3,848,824 A * 11/1974 Van Schijndel ..... 242/527.4
4,422,588 A * 12/1983 Nowisch ..... 242/524.1
5,022,597 A * 6/1991 Morizzo ..... 242/413.5
5,257,748 A * 11/1993 Morizzo ..... 242/527
7,293,736 B2 * 11/2007 Recami et al. ..... 242/542.1

* cited by examiner

*Primary Examiner*—Sang Kim

(57) ABSTRACT

A packing film stretching and rewinding machine includes a machine table provided thereon with a stretching device, a lip-folding device, a swing device and a rewinding device. A packing film can be stretched, lip-folded and rewound at the same time on the machine table. The packing film is stretched, lengthened and thinned by the stretching device and then the stretched packing film has the opposite edges folded by the lip-folding device to enhance the strength of the opposite edges of the packing film. Subsequently, the edged packing film is rewound into small rolls by the rewinding device. When the packing film is rewound into small rolls, the reel will not be deformed by tightening, needless to stop operating of the machine during whole operation, able to save manpower and lower producing cost.

4 Claims, 7 Drawing Sheets

PACKING FILM STRETCHING AND REWINDING MACHINE

BACKGROUND OF THE INVENTION

1. Field of the Invention

This invention relates to a packing film stretching and rewinding machine, particularly to one able to carry out stretching, lip-folding, swinging and re-winding for a packing film on a machine table at the same time. The packing film stretching and rewinding machine is provided with a stretching device for stretching, lengthening and thinning the packing film, and after stretched, the packing film has opposite edges folded by a lip-folding device to enhance the strength of the opposite edges of the packing film. After edge folding, the packing film can be quickly re-wound into small rolls by means of a swing device and a re-winding device. Thus, when the stretched packing film is rewound into small rolls, the portion of a reel located at the opposite edges of the packing film will not be tightened and deformed, and it is needless to stop operation of the machine in the course of whole operation, able to have the packing film stretched, lip folded and rewound into small rolls quickly, greatly increasing output, saving man power and the placing space for the machine table, reducing waste materials and lowering producing cost.

2. Description of the Prior Art

Generally, a packing film with a comparatively great thickness to be used for packing articles is manufactured by a packing film manufacturing machine and the packing film is usually wound into a large roll. Substantially, a common packing film manufacturing machine cannot manufacture a very thin packing film; therefore, the packing film manufactured has to be stretched and thinned by a stretching machine so that it can be used for packing articles conveniently. After stretched, the packing film is first wound into a large roll and then this large roll of stretched packing film is manually moved onto a rewinding machine to be rewound into lots of small rolls of packing film by means of paper reels. However, after the conventional packing film is stretched, the stretching machine has to be stopped operating before the stretched packing film is moved onto a re-winding machine to be rewound. As mentioned above, after each large roll of packing film is stretched, the stretching machine must be stopped operating and the large roll of packing film has to be moved onto the rewinding machine, thus taking lots of time and exertion. Further, a common rewinding machine can rewind only one roll of packing film at one time, with the action of rewinding complicated and slow, resulting in limited output of stretched and rewound packing films. Furthermore, after the packing film is stretched by the stretching machine, the opposite edges of the packing film will become thicker than the rest portion of the packing film; therefore, when the packing film is orderly rewound into small rolls, the thicker opposite edges of the packing film will produce a tightening force to the reel of the packing film and make the reel deformed. In addition, although the opposite edges of the packing film are thicker than the rest portion of the packing film, when the packing film is packed on an article and pulled forcefully, the opposite edges of the packing film are easy to be broken by pulling. Thus, the packing film fails to be completely packed on the article and the broken part of the packing film has to be torn off, squandering away the packing film. Moreover, there must be a large space for placing the stretching machine, the re-winding machine and other related machines at the same time.

SUMMARY OF THE INVENTION

The objective of this invention is to offer a packing film stretching and rewinding machine, able to carry out stretching, lip-folding and rewinding for a packing film at the same time on a machine table. The packing film can be stretched, lengthened and thinned by a stretching device, and then the opposite edges of the packing film are lip-folded by a lip-folding device to increase the strength of the opposite edges of the packing film. After edged, the packing film can quickly be rewound into small rolls by means of a swing device and a rewinding device. Thus, when the stretched packing film is rewound on reels, the reel located at the edges of the packing film will not be tightened and deformed by the thicker edges of the packing film. By so designing, in the course of whole operation, it is needless to stop operation of the machine, and the packing film can quickly be stretched, lip-folded and rewound into small rolls, able to greatly increase output, save man-power and the placing space for the machine table, reduce waste materials and lower producing cost.

The feature of this invention is a machine table provided thereon with a stretching device, a lip-folding device, a swing device and a rewinding device. The stretching device is composed of a material-conveying shaft, a material press wheel positioned at one side of the material-conveying shaft, plural stretching-rotating wheel different in rotating speed and positioned above the material press wheel, plural guide wheels respectively positioned between every two stretching-rotating wheels, plural conveyer guide wheels set at one side of the stretching-rotating wheels and a transmission unit assembled at the outer side of the machine table. The lip-folding device positioned above the stretching device is provided with two guide wheels having their opposite ends respectively fixed with a lip-folding plate, a conveyer roller positioned at one side of the guide wheel, and a press wheel fixed on the conveyer roller. The swing device positioned on the machine table is provided with an air pressure cylinder secured on the machine table. Two opposite support frames are fixed on the machine table, and the push rod of the air pressure cylinder is inserted out of the machine table and fixed on one of the two support frames by means of a connecting plate, and further plural guide posts are assembled between the two support frames. The rewinding device assembled over the swing device is provided with a feeding funnel and two opposite rotary disks positioned under the feeding funnel and between the two support frames of the swing device. The two opposite rotary disks are provided with a rotating shaft and respectively fixed thereon with a plurality of opposite clamping claws, and a cutter and a collection frame are assembled under the two rotary disks.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
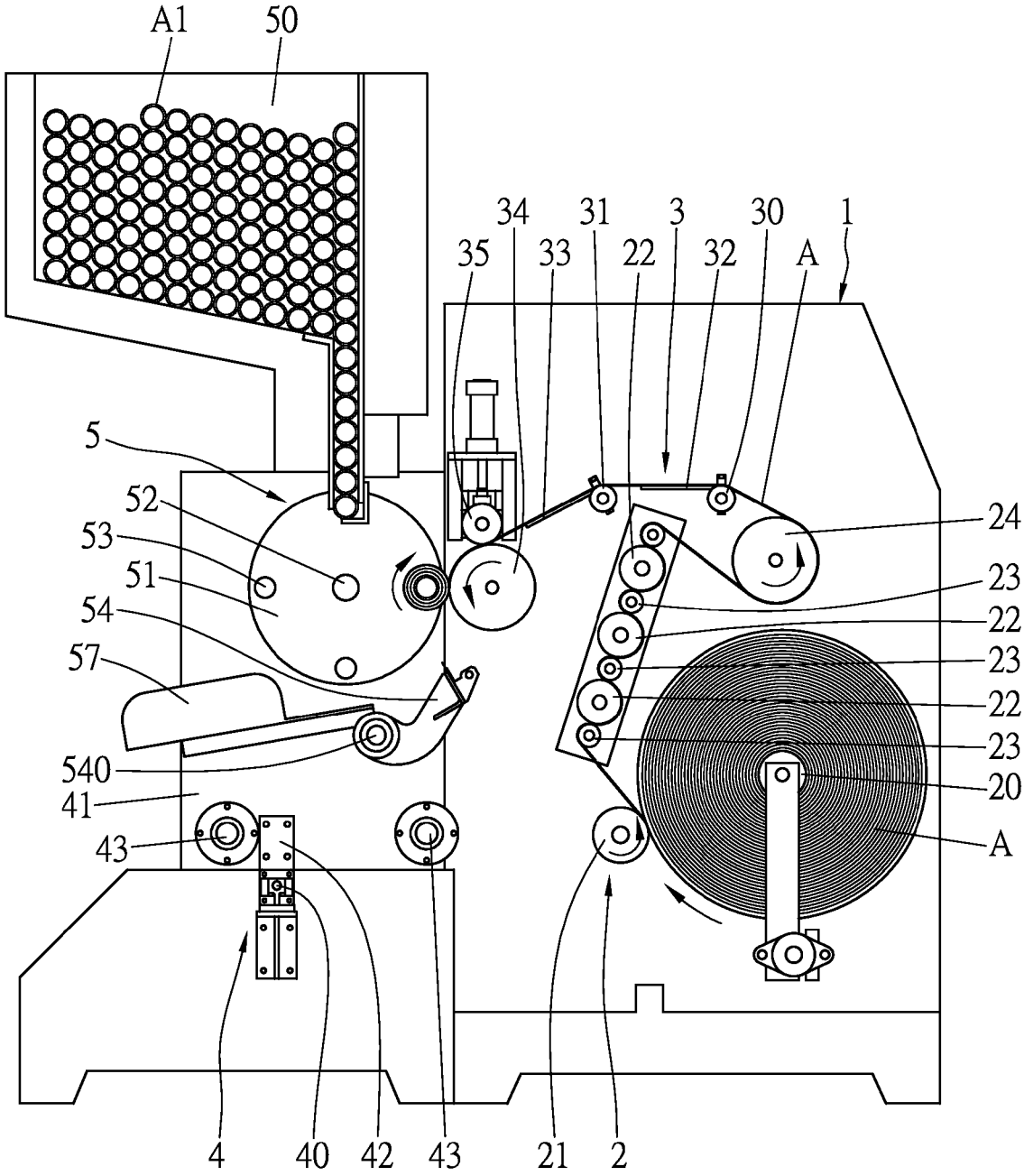
FIG. 1 is a cross-sectional view of a packing film stretching and rewinding machine in the present invention.

A preferred embodiment of a packing film stretching and rewinding machine in the present invention, as shown FIGS. 1 to 7, includes a machine table 1 provided thereon with a stretching device 2, a lip-folding device 3, a swing device 4 and a rewinding device 5.

Figure 2:
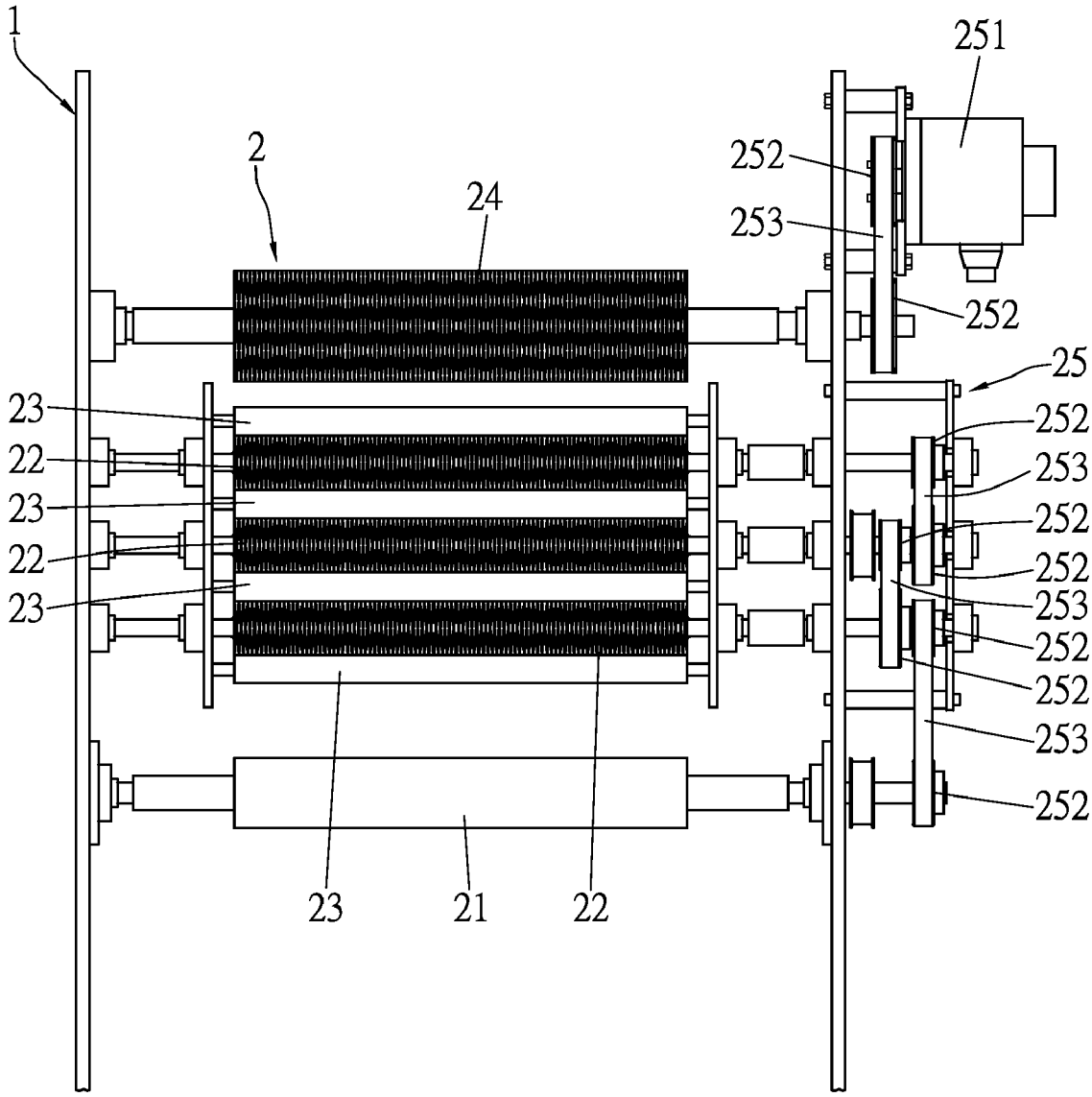
FIG. 2 is a side-sectional view of the packing film stretching and rewinding machine in the present invention.
Figure 3:
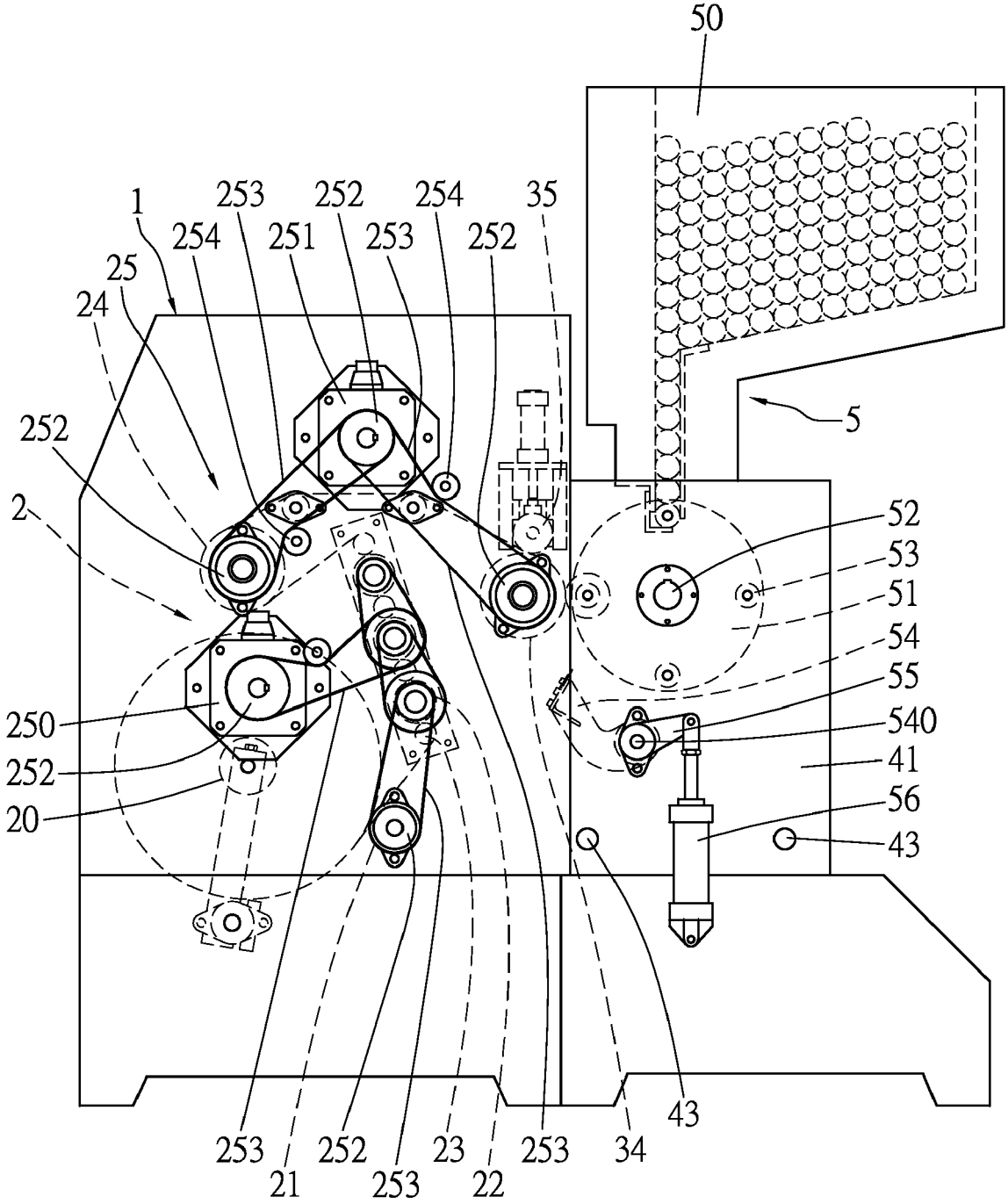
FIG. 3 is a cross-sectional view of the transmission unit of the packing film stretching and rewinding machine in the present invention.

The stretching device 2 is provided with a material-conveying rotary shaft 20 assembled thereon with a roll of packing film (A) to be stretched. A material press wheel 21 is disposed at a location adjacent to one side of the material-conveying rotary shaft 20. A plurality of stretching-rotating wheels 22 different in rotating speed and having their surfaces respectively cut with patterns are positioned above the material press wheel 21, and plural guide wheels 23 are respectively set between every two stretching-rotating wheels 22 and at the topside and the underside of the stretching-rotating wheels 22. Further a conveyer guide wheel 24 is positioned at one side of the stretching-rotating wheels 22. A transmission unit 25 is installed at the outer side of the machine table 1, as shown in FIGS. 2 and 3. The transmission unit 25 is composed of two transmission motors 250, 251, plural transmission wheels 252 different in size, plural endless transmission belts 253 and plural press wheels 254. The transmission belts 253 are respectively fitted around the transmission wheels 252 of the two transmission motors 250, 251, the stretching-rotating wheels 22, the material press wheel 21 and the transmission wheel 252 on the conveyer guide wheel 24.

Figure 4:
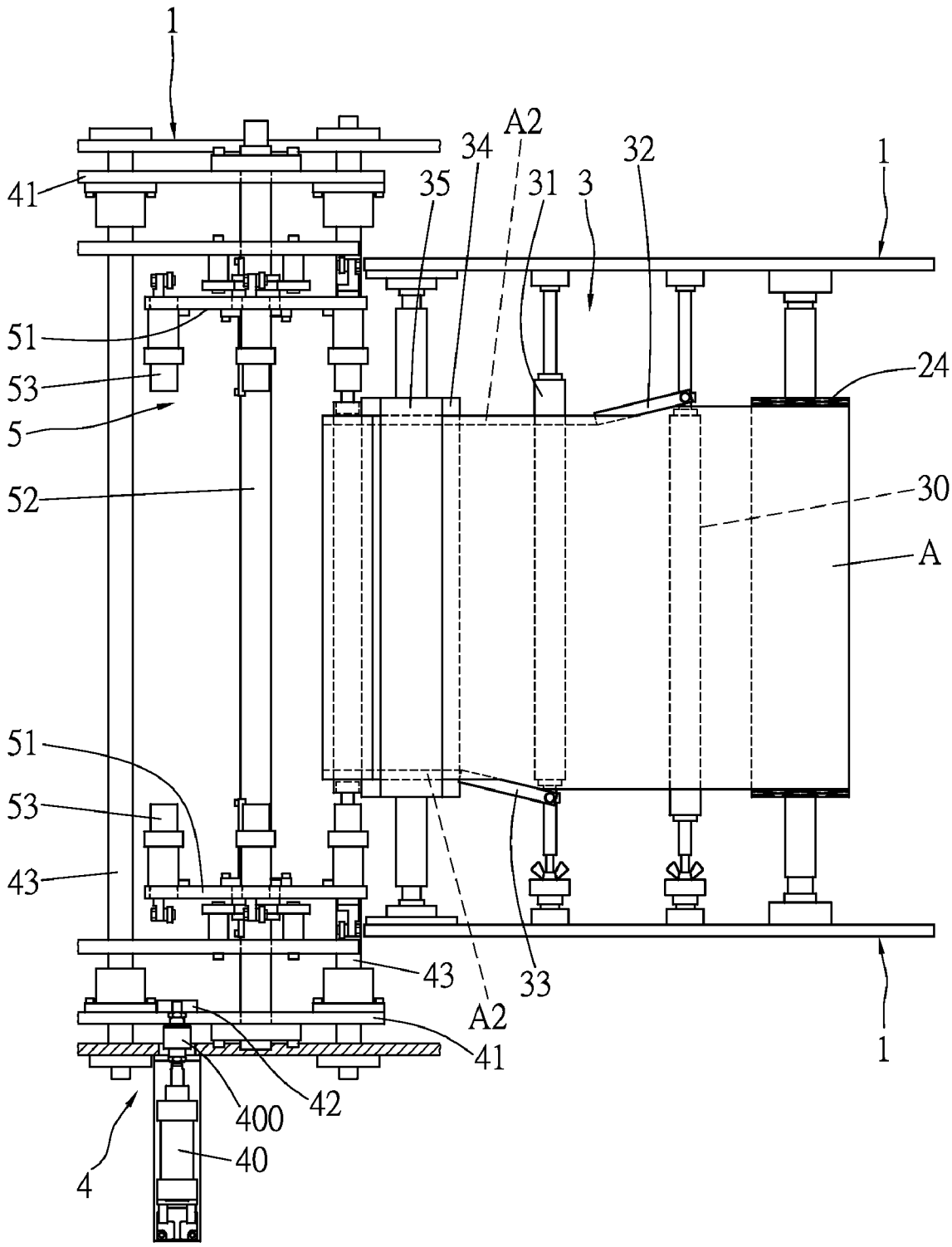
FIG. 4 is an upper view of the packing film stretching and rewinding machine in the present invention.

The lip-folding device 3, as shown in FIGS. 1 and 4, is positioned above the stretching device 2, provided with two guide wheels 30, 31 having their opposite ends respectively fixed with a lip-folding plate 32, 33, and the guide wheel 31 has one side provided with a conveyer roller 34 having topside mounted with a press wheel 35.

Figure 5:
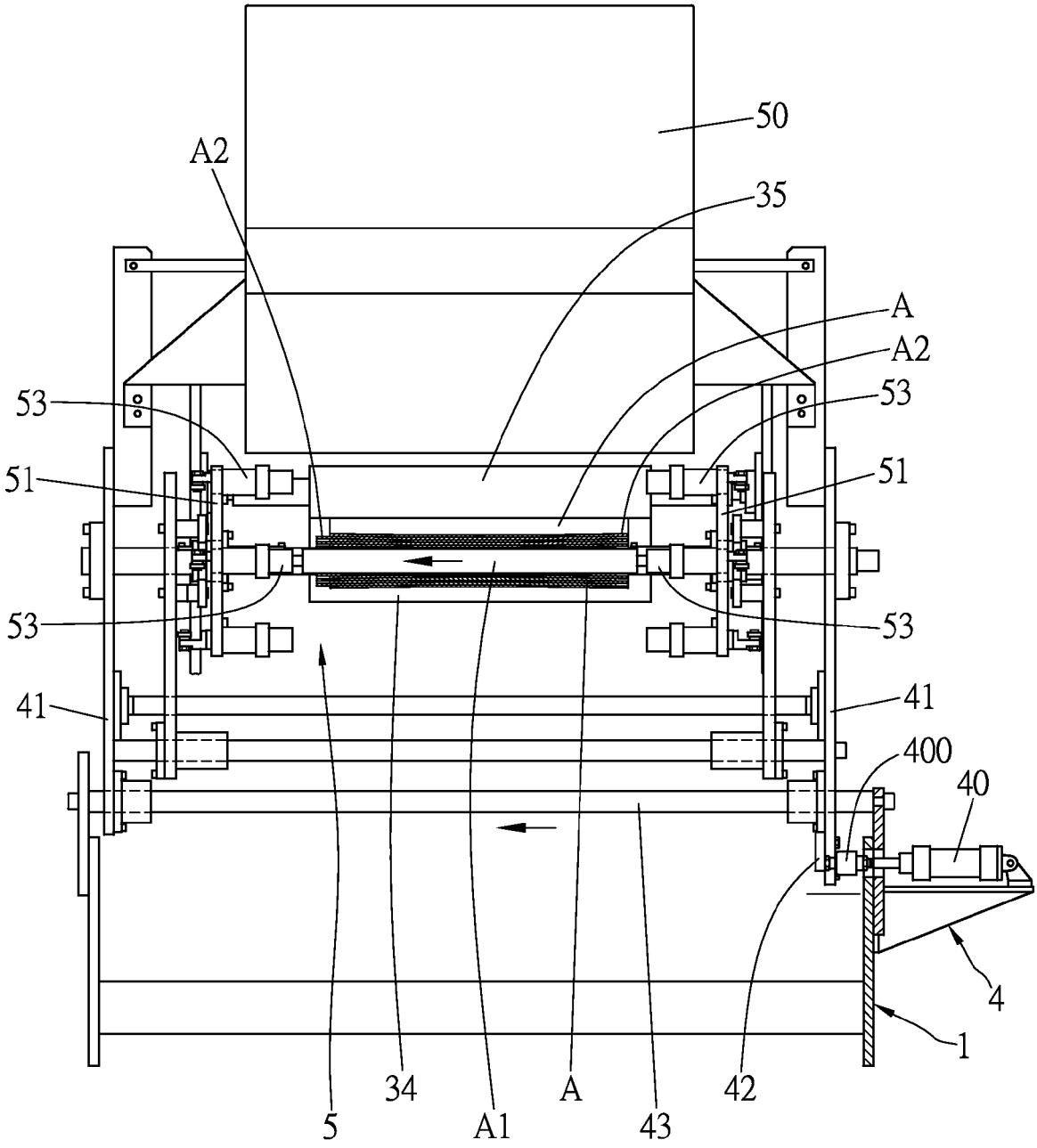
FIG. 5 is a side-sectional view of a swing device and a rewinding device in the present invention.

The swing device 4, as shown in FIGS. 1, 4 and 5, is provided with an air pressure cylinder 40 secured on the machine table 1 two opposite support frames 41 disposed on the machine table 1, a push rod 400 of the air pressure cylinder 40 inserted through the machine table 1 and fixed on one of the two support frames 41 by means of a connecting plate 42, and further two guide posts 43 assembled between the two support frames 41.

The rewinding device 5, as shown in FIGS. 1, 4 and 5, is positioned over the swing device 4, provided with a feeding funnel 50 filled therein with lots of reels A1. Two rotary disks 51 are oppositely positioned beneath the feeding funnel 50 and between the two support frames 41, provided with a rotary shaft 52 and respectively fixed thereon with four clamping claws 53 facing each other for clamping and holding reels A1. A cutter 54 is assembled under the two rotary disks 51, having a support shaft 540 inserted through the outer side of the support frames 41 and having an outer end secured with a connecting rod 55 connected with an air pressure cylinder 56. A collection frame 57 is positioned under the two rotary disks 51 for collecting rewound packing film (A). Thus, the packing film stretching and rewinding machine of this invention is finished assembling.

Figure 6:
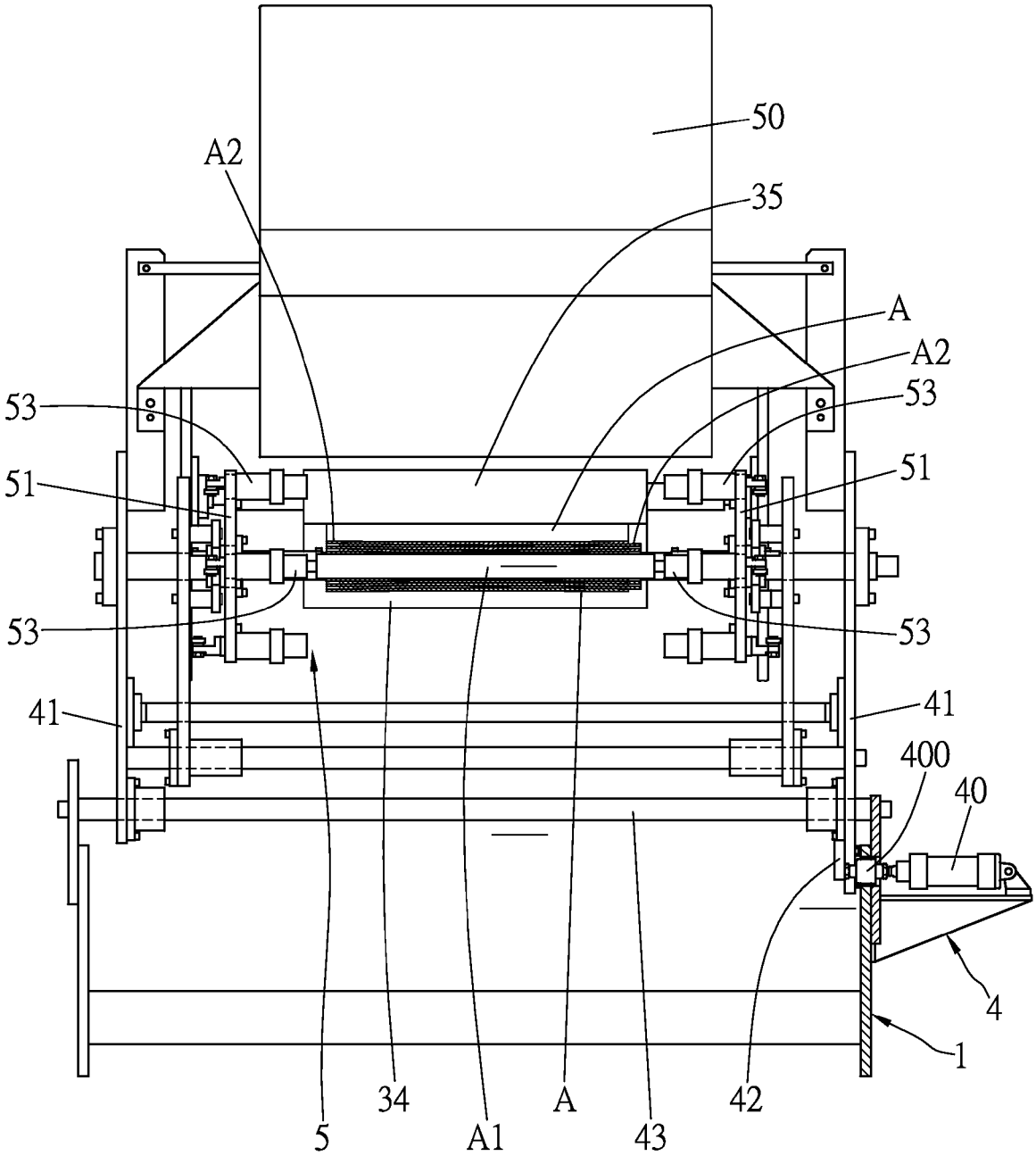
FIG. 6 is another side-sectional view of the swing device and the rewinding device in the present invention.
Figure 7:
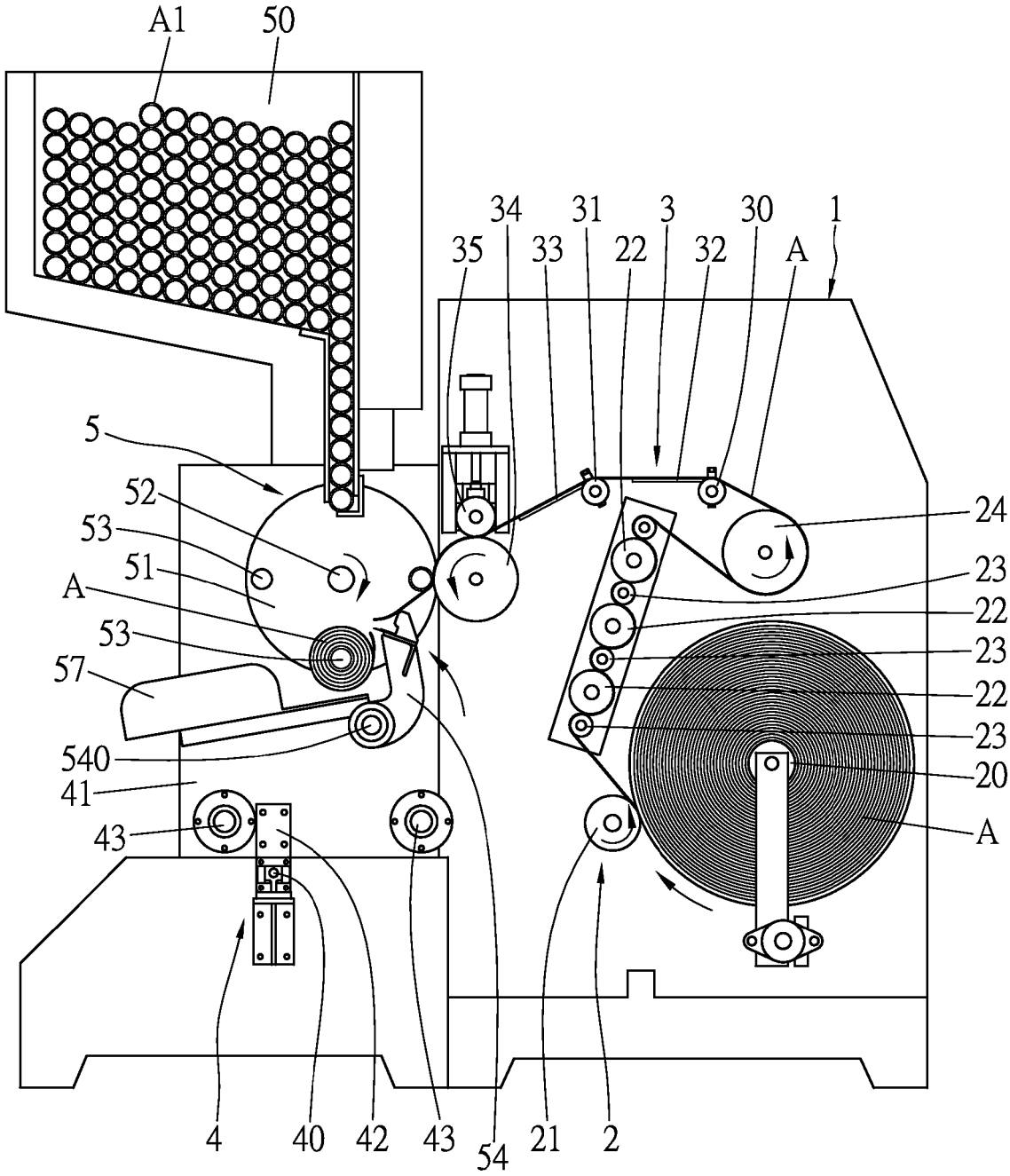
FIG. 7 is a cross-sectional view of the packing film stretching and rewinding machine in the present invention, showing a cutter cutting off the packing film.

In using, referring to FIGS. 1 to 7, firstly, a large roll of packing film (A) to be stretched is mounted on the material-conveying shaft 20 of the stretching device 2 to be held by the material press wheel 21 at one side of the material-conveying shaft 20, and then the packing film (A) is pulled to pass along each stretching rotary wheel 22 and each guide wheel 23. Simultaneously, the stretching-rotating wheels 22 will be respectively actuated by the different-sized transmission wheels 252 of the transmission unit 25 to rotate at different speeds to let each stretching-rotating wheel 22 form rotating speed different and produce stretching ratio. Thus, when passing along each stretching-rotating wheel 22, the packing film (A) will be stretched, lengthened and thinned. Subsequently, the stretched packing film (A) is conveyed to the guide wheel 30 of the lip-folding device 3 via the conveyer guide wheel 24, as shown in FIGS. 1 and 4, to have one edge of the packing film (A) guided and bent downward by the lip-folding plate 32 on the guide wheel 30, and when the packing film (A) is conveyed to another guide wheel 31, the other edge of the packing film (A) will be bent downward by the other lip-folding plate 33, letting the opposite two edges of the packing film (A) bent downward to form a lip edge A2 respectively. Afterward, the packing film (A) with lip edges A2 is conveyed to the rewinding device 5 via the conveyer roller 34 and during being conveyed, the opposite lip edges A2 of the packing film (A) will be pressed by the press wheels 35 and stuck to the packing film (A) so as to enhance the strength of the opposite edges of the packing film (A). Meanwhile, the reels A1 in the feeding funnel 50 of the rewinding device 5 will be actuated to drop to a location between the two rotary disks 51 to be clamped by the opposite clamping claws 53 and positioned on the two rotary disks 51, and then the rotary disks 51 are rotated to move the reel A1 to a location corresponding with one side of the conveyer roller 34 (i.e. a rewinding position) to let the edged packing film (A) guided and conveyed onto the reel A1, which will be actuated by the conveyer roller 34 to rotate and wind up the edged packing film (A). In the meantime, the air pressure cylinder 40 of the swing device 4 will be operated to carry out reciprocating action to extend outward and contract inward, as shown in FIGS. 5 and 6, to drive the two support frames 41 to move to and fro on the two guide posts 43 and actuate the rewinding device 5 to shift back and forth to let the thicker opposite edges of the packing film (A) wound on the reel A1 out of alignment. Thus, after the stretched and edged packing film (A) is rewound on the reel A1, the thicker opposite edges of the packing film (A) are not arranged in alignment to form greater thickness but distributed over the reel A1, able to disperse the tightening force of the opposite edges imposed upon the reel A1 for preventing the reel A1 at the location of the opposite edges of the packing film (A) from being deformed by tightening. When one reel A1 on the rotary disks 51 is rotated to rewind the packing film (A) up to a size preset, the rotary disks 51 will be turned for 90 degrees, as shown in FIG. 7, to let the packing film (A) pulled downward, and meanwhile another two opposite clamping claws 53 on the two rotary disks 51, which clamp another reel A1, will be rotated to the rewinding location (at one side of the conveyer roller 34). When the reel A1 having the packing film (A) rewound thereon is turned and shifted downward to a location over the collection frame 57, the air pressure cylinder 56 is operated to actuate the cutter 54 of the rewinding device 5 to turn and cut off the packing film (A) that is pulled downward and then the reel A1 rewound thereon with the packing film (A) will be released from the clamping of the clamping claws 53 and drop onto the collection frame 57 to be gathered. Simultaneously, another reel A1 on the rotary disks 51 will carry out another rewinding action in order.

By so designing, the packing film (A) can be stretched, lip-folded, and re-wound on the machine table 1 at the same time. Specifically, the packing film (A) can be stretched by the stretching device 2 to be lengthened and thinned, and after stretched, the packing film (A) has the opposite edges folded by the lip-folding device 3 to elevate the strength of the opposite edges of the packing film (A). After edged, the packing film (A) can quickly be rewound into small rolls by means of the swing device 4 and the rewinding device 5.

To sum up, this invention has the following advantages.

1. When the stretched packing film (A) is rewound on the reel A1, the reel A1 at the locations of the opposite edges of the packing film (A) will not be deformed by tightening.

2. In the course of whole operation, it is needless to stop operating of the machine.

3. The integrated operation of stretching, lip-folding and rewinding can greatly increase output, economize manpower and time, save machine table placing space, reduce waste materials and lower producing cost.

While the preferred embodiment of the invention has been described above, it will be recognized and understood that various modifications may be made therein and the appended claims are intended to cover all such modifications that may fall within the spirit and scope of the invention.

What is claimed is:

1. A packing film stretching and rewinding machine comprising a machine table: and characterized by said machine table assembled thereon with a stretching device, a lip-folding device, a swing device and a rewinding device, said stretching device provided with a material-conveying rotary shaft, said material-conveying rotary shaft having one side disposed with a material press wheel, plural stretching-rotating wheels with different rotating speeds positioned above said material press wheel, plural guide wheels respectively set between every two of said stretching-rotating wheels and at the topside and the underside of said stretching-rotating wheel, a conveyer guide wheel positioned to one side of said stretching-rotating wheel, said machine table having an outer side provided with a transmission unit, said lip-folding device positioned above said stretching device, said lip-folding device disposed with two guide wheels, said two guide wheels having their opposite ends respectively fixed with a lip-folding plate, a conveyer roller located at one side of said guide wheel, said conveyer roller having topside mounted with a press wheel, said swing device assembled on said machine table, said swing device having an air pressure cylinder secured on said machine table, said machine table disposed with two opposite support frames, said air pressure cylinder having a push rod inserted through said machine table and fixed on one of said two support frames by means of a connecting plate, plural guide posts assembled between said two support frames, said rewinding device positioned above said swing device, said rewinding device provided with a feeding funnel, two opposite rotary disks fixed under said feeding funnel and positioned between said two support frames of said swing device, said two rotary disks provided with a rotating shaft and respectively fixed thereon with plural opposite clamping claws, a cutter and a collection frame respectively assembled under said two rotary disks.

2. The packing film stretching and rewinding machine as claimed in claim 1, wherein each said stretching-rotating wheel of said stretching device has an outer surface provided with cut patterns.

3. The packing film stretching and rewinding machine as claimed in claim 1, wherein said transmission unit is composed of two transmission motors, plural transmission wheels different in size, plural endless transmission belts and plural press wheels, said transmission belts respectively fitted around said transmission wheels of said two transmission motors, and said stretch-rotating wheels and around said material press wheel and said transmission wheel on said conveyer guide wheel.

4. The packing film stretching and rewinding machine as claimed in claim 1, wherein the support frame of said cutter of said rewinding device is inserted out of said two support frames of said swing device and has an outer end fixed with a connecting rod that is connected with an air pressure cylinder.

* * * * *